US005454307A

United States Patent [19]

Chen

[11] Patent Number: 5,454,307

[45] Date of Patent: Oct. 3, 1995

[54] APPARATUS FOR PRINTING SHOE SOLE

[76] Inventor: Jin-Bin Chen, No. 67, Section 1, Fen Tsau Road, Fen Yuan Hsiang, Chang Hua Hsien, Taiwan

[21] Appl. No.: 384,741

[22] Filed: Feb. 7, 1995

[51] Int. Cl.[6] ..... B41F 17/00

[52] U.S. Cl. ..... 101/35; 101/126

[58] Field of Search ..... 101/35, 114, 125, 101/126, 127.1, 129, 333, 4, 41, 407.1, 485

[56] References Cited

U.S. PATENT DOCUMENTS

| | | | |
|---|---|---|---|
| 3,673,954 | 7/1972 | Lala | 101/126 |
| 4,226,181 | 10/1980 | Ericsson | 101/129 |
| 4,502,380 | 3/1985 | Meador | 101/129 |
| 5,090,320 | 2/1992 | Nave | 101/126 |
| 5,176,078 | 1/1993 | Homma et al. | 101/126 |

FOREIGN PATENT DOCUMENTS

| | | | |
|---|---|---|---|
| 0259776 | 3/1988 | European Pat. Off. | 101/126 |
| 3412497 | 10/1985 | Germany | 101/35 |

*Primary Examiner*—Edgar S. Burr
*Assistant Examiner*—Anthony H. Nguyen
*Attorney, Agent, or Firm*—Charles E. Baxley

[57] ABSTRACT

A device for printing patterns on the curved outer peripheral portion of a shoe sole includes a soft material supported on a table for supporting pigment. A frame is pivotally supported on the table and includes two legs each having an actuators. A last is secured to one of the actuators for supporting the shoe sole and a clamping member is secured to the other actuator and movable toward the last for clamping the shoe sole in place. Another actuator may move the last and the shoe sole downward toward the soft material so as to engage the side portion of the shoe sole with the pigment applied on the soft material.

3 Claims, 3 Drawing Sheets

APPARATUS FOR PRINTING SHOE SOLE

BACKGROUND OF THE INVENTION

1. Field of the Invention

The present invention relates to an apparatus, and more particularly to an apparatus for printing side portions of shoe soles.

2. Description of the Prior Art

Typically, labels or similar articles are adhered to the side portion or the peripheral portion of the shoe soles. The trademarks or other marks are printed on the labels so as to be attached to the shoe soles. Because the peripheral portion of the shoe soles are curved surfaces and may not be easily printed patterns thereon, the labels are required for attaching the trademarks or marks onto the shoe sole. However, the labels should be attached to the shoe soles manually such that a number of man power are required for conducting the adhering processes. In addition, the labels may not be stably and firmly secured to the curved outer peripheral portion of the shoe soles.

The present invention has arisen to mitigate and/or obviate the afore-described disadvantages of the conventional shoe soles.

SUMMARY OF THE INVENTION

The primary objective of the present invention is to provide an apparatus for printing patterns on the curved outer peripheral portion of the shoe soles.

In accordance with one aspect of the invention, there is provided an apparatus for printing a shoe sole comprising a working table including a middle portion, a first end portion and a second end portion, a first track means longitudinally provided on the working table and extended from the first end portion of the working table to the second end port ion, a soft material slidably engaged on the track means and movable between the first end portion and the second end portion for supporting pigment thereon, stand means provided on the middle portion of the working table, a frame pivotally coupled to the stand means at a pivot axle and including a pair of legs extended in parallel therefrom, the legs each including a free end portion located above the second end portion of the working table, a first actuator and a second actuator secured to the free end portions of the pair of legs and aligned in line with each other, a last secured to the first actuator and located above the first track means for supporting the shoe sole, the first actuator being provided for rotating the last and the shoe sole, a clamping member secured to the second actuator and movable toward the last by the second actuator for clamping the shoe sole in place, and a third actuator coupled to the free end portion of one of the pair of legs for rotating the frame and for moving the last and the shoe sole downward toward the soft material and for engaging the shoe sole with the pigment applied on the soft material.

A second track means is further provided on the first end portion of the working table and arranged in perpendicular to the first track means and arranged above the first track means, a slide is slidably engaged on the second track means, and a screen is supported in the slide for applying pigment onto the soft material.

A film is provided on top of the soft material for supporting the pigment thereon.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
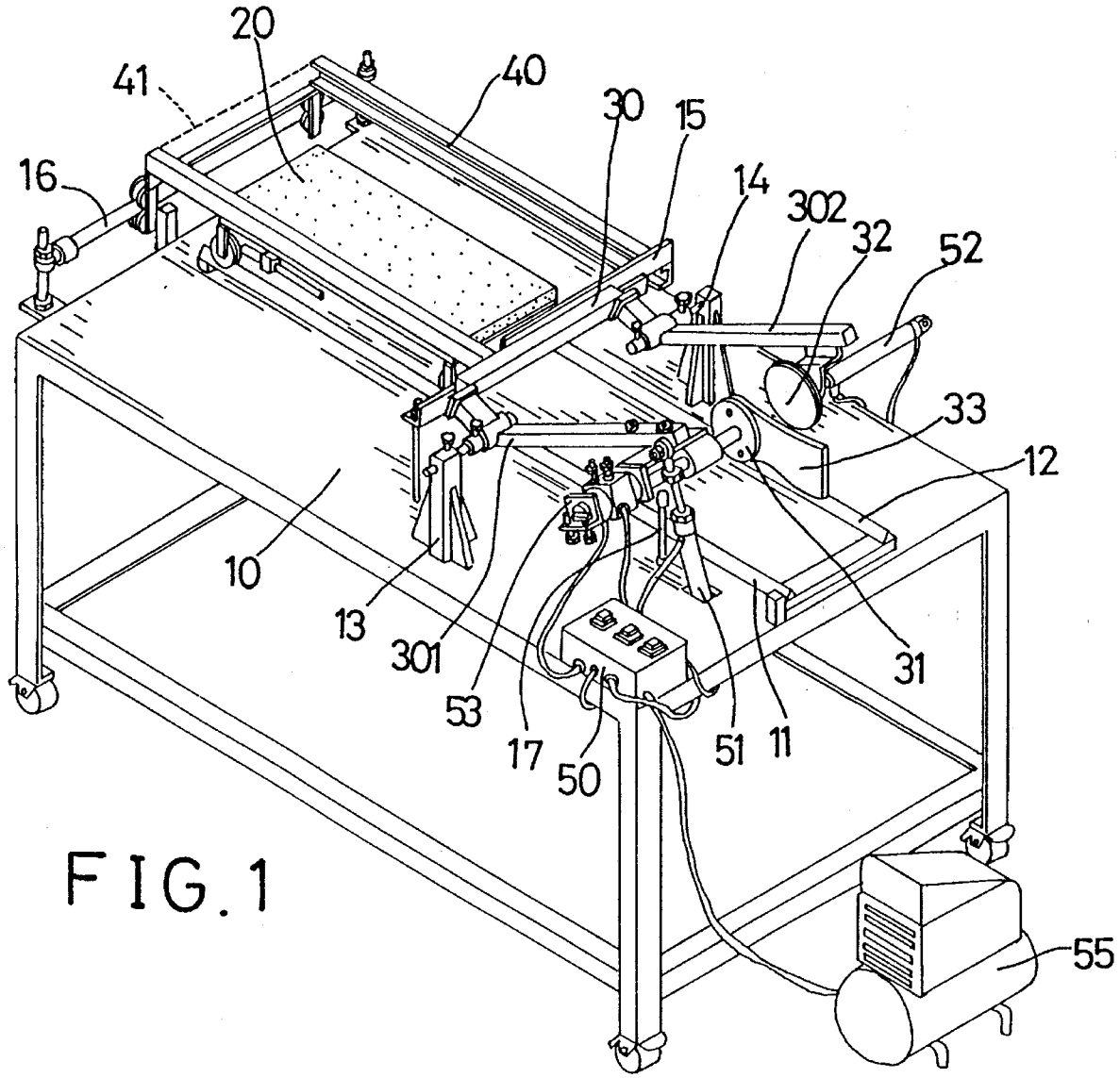
FIG. 1 is a perspective view of an apparatus for printing patterns on the curved outer peripheral portion of the shoe soles in accordance with the present invention.
Figure 2:
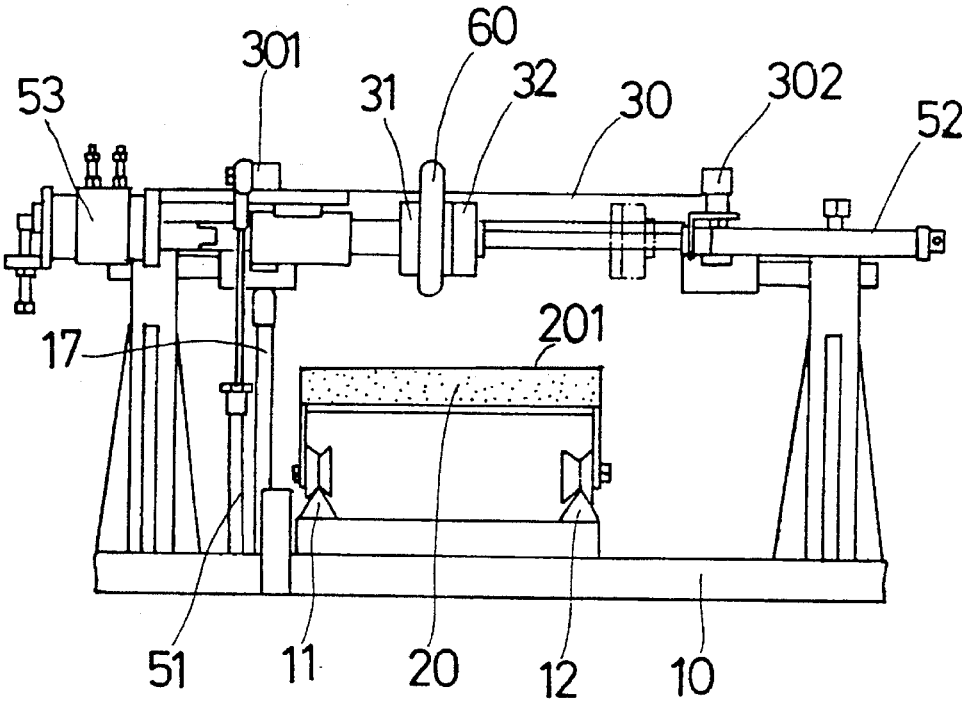
FIGS. 2 and 3 are partial side views illustrating the operation of the apparatus.

Referring to the drawings, and initially to FIGS. 1 and 2, an apparatus in accordance with the present invention is provided for printing patterns on the curved outer peripheral portion of the shoe soles, particularly the mid-soles. The apparatus comprises a working table 10 including a pair of tracks 11, 12 arranged longitudinally and in parallel with each other. A spongy material or a soft material 20 is slidably supported on the tracks 11, 12 and movable along the tracks 11, 12. A film 201 is provided on the soft material 20 for supporting pigment thereon. It is preferable that the pigment has predetermined pattern which is going to be applied to the curved outer peripheral portion of the shoe soles. A pair of stands 13 are provided on the middle portion of the working table 10.

A substantially U-shaped frame 30 is pivotally coupled to the stands 13 at pivot axles 14 and includes two legs 301, 302 extended in parallel with each other. The legs 301, 302 each includes a free end distal to the pivot axles 14. An actuator 51 is coupled to the free end of the leg 301 for rotating the frame 30 about the pivot axles 14. Two actuators 52, 53 are secured to the free ends of the legs 301, 302 respectively and are aligned in one line. Two clamping members 32, 31 are coupled to the actuators 52, 53 respectively. A molding last 33 is secured to the clamping member 31. The clamping member 32 is moved toward the other clamping member 31 by the actuator 52 in order to clamp the shoe sole 60 in place. The actuators 51, 52, 53 are controlled by a control box 50 and an air compressor 55 is provided for providing pressurized air to the actuators 51, 52, 53. The actuator 53 which is provided for rotating the last 33 is commercially available and will not be described in further details.

Another pair of tracks 15, 16 are arranged in parallel on one side of the working table 10 and are arranged in perpendicular to the tracks 11, 12. A slide 40 is slidably engaged on the tracks 15, 16 for supporting a screen 41 thereon. The screen 41 is used in screen printing operations and is provided for applying pigment and/or pattern on the file 201 which is supported on the soft material 20. The track 15 may be provided as a stop means for limiting the rotational movement of the frame 30. Another stop means 17 is arranged below the actuator 53 for engaging with the actuator 53 so as to limit the rotational movement of the frame 30.

Figure 3:
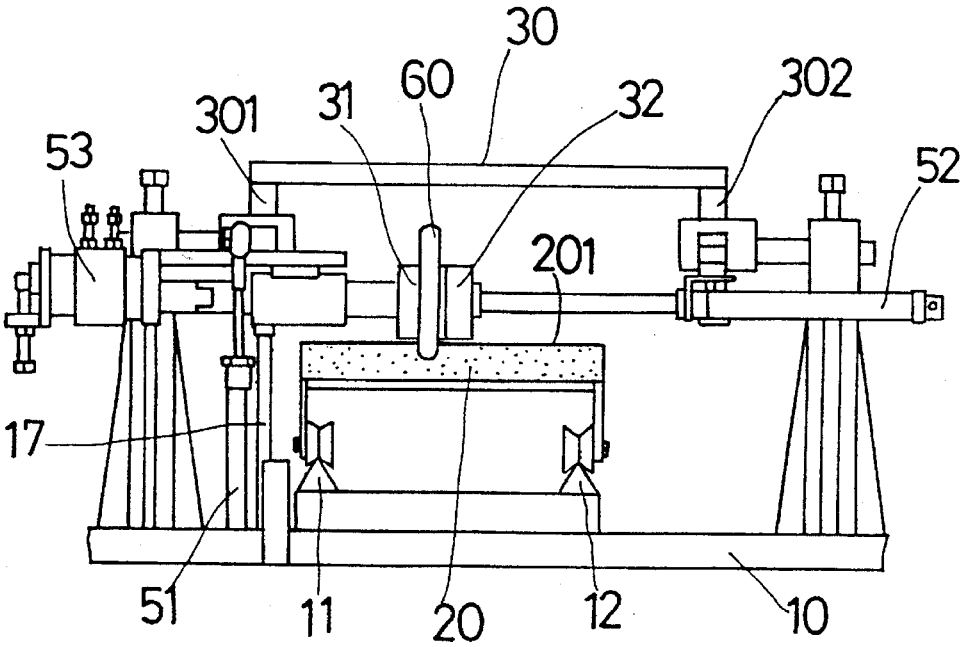
Figure 4:
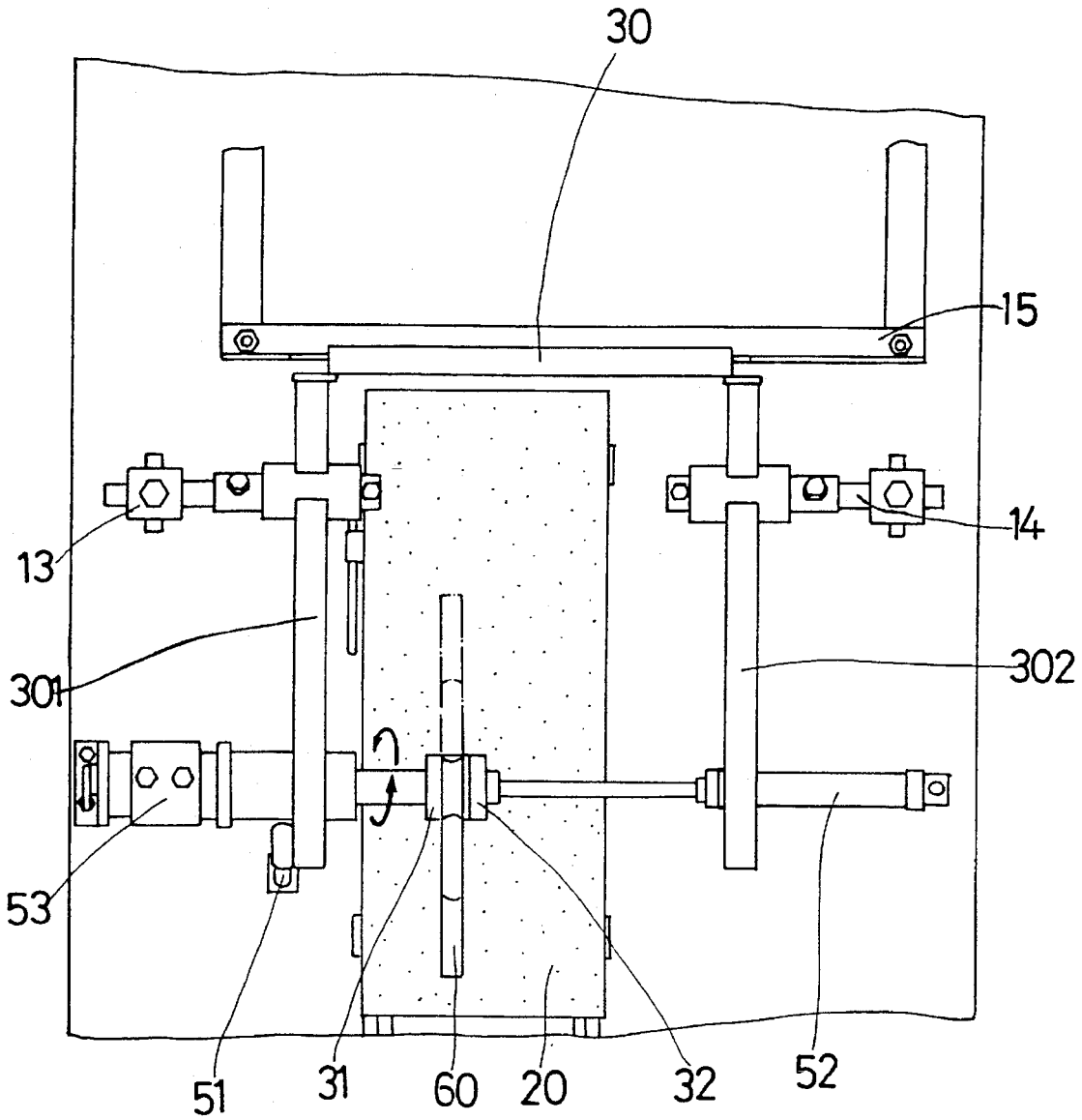
FIG. 4 is a partial top view illustrating the operation of the apparatus.

In operation, as shown in FIGS. 1 and 2, the screen 41 supported on the slide 40 is moved along the tracks 15, 16 to the position located above the soft material 20 in order to apply pigment and/or pattern on the film 201. The soft material 20 is then moved along the tracks 11, 12 to the position located below the last 33 onto which a shoe sole 60 is engaged. The shoe sole 60 and the last 33 are then moved downward toward the soft material 20 by the actuator 54 so as to engage the shoe sole 60 with the pigment provided on the film 201, best shown in FIG. 3. Due to the soft material, one side of the curved outer peripheral portion of the shoe sole may fully engage with the pigment provided on the film 201. The last 33 is then moved upward away from the soft material 20 by the actuator 51. The actuator 53 is then actuated to rotate the last 33 and the shoe sole 60 for 180 degrees such that the other side of the shoe sole may face downward toward the soft material 20, best shown in FIG. 4. The actuator 51 is then actuated again in order to move the shoe sole 60 downward to engage with pigment provided on the film 201, such that both sides of the shoe sole may be engage with the pigment provided on top of the film 201.

Accordingly, the apparatus in accordance with the present invention may print patterns on the curved outer peripheral portion of the shoe soles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An apparatus for printing a shoe sole comprising:

a working table including a middle portion, a first end portion and a second end portion, a first track means longitudinally provided on said working table and extended from said first end portion of said working table to said second end portion, a soft material slidably engaged on said track means and movable between said first end portion and said second end portion for supporting pigment thereon, stand means provided on said middle portion of said working table, a frame pivotally coupled to said stand means at a pivot axle and including a pair of legs extended in parallel therefrom, said legs each including a free end portion located above said second end portion of said working table, a first actuator and a second actuator secured to said free end portions of said pair of legs and aligned in line with each other, a last secured to said first actuator and located above said first track means for supporting said shoe sole, said first actuator being provided for rotating said last and said shoe sole, a clamping member secured to said second actuator and movable toward said last by said second actuator for clamping said shoe sole in place, and a third actuator coupled to said free end portion of one of said pair of legs for rotating said frame and for moving said last and said shoe sole downward toward said soft material and for engaging said shoe sole with said pigment applied on the soft material.

2. An apparatus according to claim 1 further comprising a second track means provided on said first end portion of said working table and arranged in perpendicular to said first track means and arranged above said first track means, a slide slidably engaged on said second track means, and a screen supported in said slide for applying pigment onto said soft material.

3. An apparatus according to claim 1 further comprising a film provided on top of said soft material for supporting said pigment thereon.

* * * * *